US012638222B2

(12) United States Patent
Kondo et al.

(10) Patent No.: US 12,638,222 B2
(45) Date of Patent: May 26, 2026

(54) HEAT PUMP DEVICE

(71) Applicant: FUJITSU GENERAL LIMITED, Kanagawa (JP)

(72) Inventors: Masahiro Kondo, Kanagawa (JP); Daiki Shimano, Kanagawa (JP); Kazuki Suda, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 119 days.

(21) Appl. No.: 18/847,687

(22) PCT Filed: Mar. 24, 2023

(86) PCT No.: PCT/JP2023/011974
§ 371 (c)(1),
(2) Date: Sep. 17, 2024

(87) PCT Pub. No.: WO2023/190228
PCT Pub. Date: Oct. 5, 2023

(65) Prior Publication Data

US 2025/0198678 A1 Jun. 19, 2025

(30) Foreign Application Priority Data

Mar. 28, 2022 (JP) ..... 2022-052475

(51) Int. Cl.
*F24H 4/00* (2006.01)
*F24H 4/02* (2022.01)
(Continued)

(52) U.S. Cl.
CPC ..... *F25B 49/02* (2013.01); *F24H 4/02* (2013.01); *F24H 15/34* (2022.01); *F24H 15/38* (2022.01);
(Continued)

(58) Field of Classification Search
CPC .... F25B 30/02; F25B 49/02; F25B 2339/047; F25B 2700/1931; F25B 2700/21161;
(Continued)

(56) References Cited

FOREIGN PATENT DOCUMENTS

EP 2857761 A1 4/2015
GB 2527013 A 12/2015
(Continued)

OTHER PUBLICATIONS

Mar. 18, 2026, European Search Report issued for related EP Application No. 23780238.4.

*Primary Examiner* — Jonathan Bradford
(74) *Attorney, Agent, or Firm* — Paratus Law Group, PLLC

(57) ABSTRACT

A heat pump device includes a refrigerant circuit that includes a compressor, a water circuit, that includes a flow adjustor that adjusts a flow of the water, and a terminal that is connected to the water circuit. The heat pump device includes a first detector that detects a condensing pressure of a refrigerant of the refrigerant circuit, a second detector that detects a discharged heated-water temperature that is a temperature of the water flowing into the terminal, and a controller that executes a protection operation of adjusting the condensing pressure of the refrigerant when the condensing pressure that is detected by the first detector exceeds a pressure threshold. The controller selects, as a subject of control in the protection operation, any one of the compressor and the flow adjustor based on the discharged heated-water temperature that is detected by the second detector.

7 Claims, 5 Drawing Sheets

(51) Int. Cl.

| | |
|---|---|
| ***F24H 15/34*** | (2022.01) |
| ***F24H 15/38*** | (2022.01) |
| ***F25B 30/02*** | (2006.01) |
| ***F25B 49/00*** | (2006.01) |
| ***F25B 49/02*** | (2006.01) |

(52) U.S. Cl.
CPC ..... *F25B 30/02* (2013.01); *F25B 49/005* (2013.01); *F25B 2339/047* (2013.01); *F25B 2700/1931* (2013.01); *F25B 2700/21161* (2013.01)

(58) Field of Classification Search
CPC ..... F24H 4/00; F24H 4/02; F24H 4/04; F24H 15/34; F24H 15/38
See application file for complete search history.

(56) References Cited

FOREIGN PATENT DOCUMENTS

| | | | |
|---|---|---|---|
| JP | 2002-340402 | A | 11/2002 |
| JP | 2006-258375 | A | 9/2006 |
| JP | 2011-027372 | A | 2/2011 |
| JP | 2013-170764 | A | 9/2013 |
| JP | 2015-072102 | A | 4/2015 |
| JP | 2015-205061 | A | 11/2015 |
| JP | 2016-166715 | A | 9/2016 |

HEAT PUMP DEVICE

CROSS REFERENCE TO PRIOR APPLICATION

This application is a National Stage Patent Application of PCT International Patent Application No. PCT/JP2023/011974 (filed on Mar. 24, 2023) under 35 U.S.C. § 371, which claims priority to Japanese Patent Application No. 2022-052475 (filed on Mar. 28, 2022), which are all hereby incorporated by reference in their entirety.

FIELD

The present invention relates to a heat pump device.

BACKGROUND

For example, a heat pump device that includes a refrigerant circuit in which a refrigerant circulates with a compressor and a water circuit in which water circulates and that produces heated water by heat exchange with the refrigerant and that supplies the heated water to a plurality of indoor units using a circulation pump that is provided in the water circuit is known. The heat pump device produces heated water by heat exchange with the refrigerant and circulates the heated water to the indoor units using the circulation pump, thereby adjusting the temperature and humidity of an indoor space in which the indoor units are set.

In the heat pump device, the pressure of the refrigerant circuit sometimes increases or decreases excessively because of variation in the outdoor temperature, etc. Thus, in order to deal with an excessive increase and decrease of the pressure of the refrigerant circuit, the heat pump device adjusts a flow adjustment valve that adjusts a rotation rate of a compressor in the refrigerant circuit and a flow of the refrigerant in the refrigerant circuit using the detected pressure and temperature of the refrigerant circuit and performs a pressure protection operation on the refrigerant circuit.

CITATION LIST

Patent Literature

Patent Literature 1: Japanese Laid-open Patent Publication No. 2015-205061

SUMMARY

Technical Problem

In the conventional heat pump device, however, when the pressure protection operation is performed by only control on the side of the refrigerant circuit, for example, control on the compressor, this sometimes results in an excessive protection operation. When the rotation rate of the compressor is lowered, the flow of the refrigerant and the differential pressure in the refrigerant circuit decrease, condensing and evaporating ability lowers, ability needed to adjust the temperature of the indoor unit is not sufficiently fulfilled, and it takes time to reach an appropriate room temperature, which diminishes comfortableness to a user. Such a problem is not limited to an indoor unit of an air conditioner and it can occur in a water heater that uses heated water that circulates.

In view of such a problem, an object of the present invention is to provide a heat pump device that makes it possible to minimize a decrease in comfortableness and perform the pressure protection operation as appropriate.

Solution to Problem

According to an aspect of an embodiment, the heat pump device including a refrigerant circuit, a water circuit, and a terminal. The refrigerant circuit in which a refrigerant circulates includes a compressor. The water circuit in which water circulates, includes a flow adjustor that adjusts a flow of the water. The water circuit produces heated water by heat exchange of the water with the refrigerant. The terminal is connected to the water circuit. The heat pump device includes a first detector, a second detector and a controller. The first detector detects a condensing pressure of the refrigerant of the refrigerant circuit. The second detector detects a discharged heated-water temperature that is a temperature of the water flowing into the terminal. The controller executes a protection operation of adjusting the condensing pressure of the refrigerant when the condensing pressure that is detected by the first detector exceeds a pressure threshold. The controller selects, as a subject of control in the protection operation, any one of the compressor and the flow adjustor based on the discharged heated-water temperature that is detected by the second detector.

Advantageous Effects of Invention

It is possible to minimize a decrease in comfortableness and perform a pressure protection operation as appropriate as an aspect.

DESCRIPTION OF EMBODIMENTS

An embodiment of a heat pump device, etc., disclosed in the preset application will be described in detail below according to the drawings. Note that the embodiment does not limit the disclosed technique. Each embodiment illustrated below may be modified as appropriate within a range where no inconsistency is caused.

Embodiment 1

Configuration of Heat Pump Device

Figure 1:
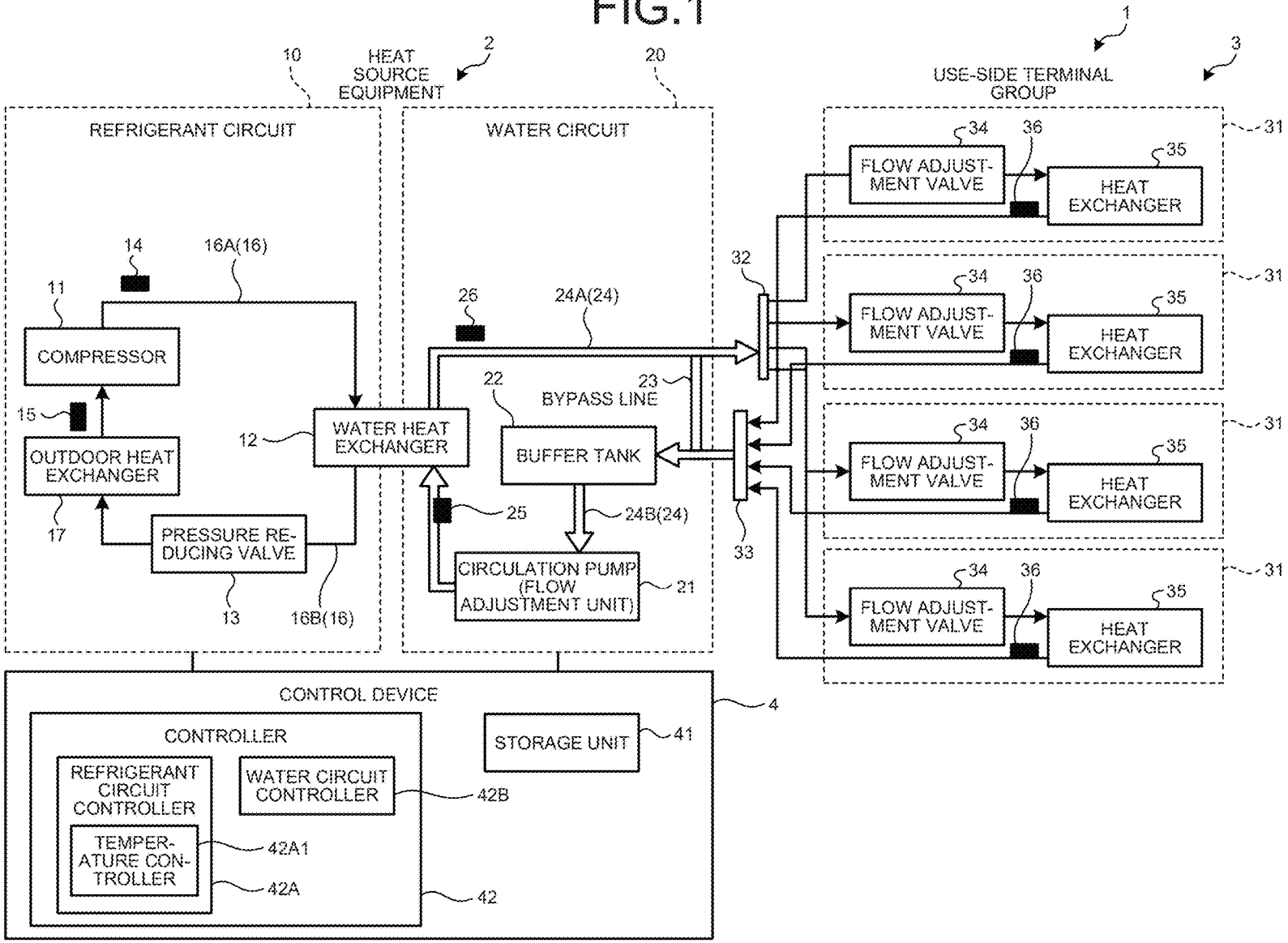
FIG. 1 is an illustration illustrating an example of a heat pump device of an embodiment.

FIG. 1 is an illustration illustrating an example of a heat pump device 1 of the present embodiment. The heat pump device 1 illustrated in FIG. 1 includes heat source equipment 2, a use-side terminal group 3, and a control device 4. The heat source equipment 2 includes a refrigerant circuit 10 and a water circuit 20. The refrigerant circuit 10 is a line in which a refrigerant circulates inside and external air and the refrigerant perform heat exchange. The water circuit 20 is a line in which water circulates and the refrigerant from the refrigerant circuit 10 and water perform heat exchange. The use-side terminal group 3 is set in an indoor space and is, for example, a plurality of use-side terminals 31, such as a floor-heating device of a direct contact system that is used in an environment where a user is able to make direct contact, a fan convector of a forced convection system, and a panel heater of a natural convection system. The control device 4 controls the entire heat pump device 1.

Configuration of Refrigerant Circuit

The refrigerant circuit 10 includes a compressor 11, a water heat exchanger 12, a pressure reducing valve 13, and an outdoor heat exchanger 17, which are connected mutually via each set of refrigerant piping.

The compressor 11 is an ability variable compressor of a high pressure vessel type whose operation capacity is variable according to driving of a motor that is not illustrated in the drawings and whose rotation speed is controlled by an inverter. The water heat exchanger 12 is a heat exchanger that causes heat exchange between the refrigerant and water passing inside. The water heat exchanger 12 functions as a condenser that condenses the refrigerant passing inside in a heated water heating operation. The water heat exchanger 12 is connected to the compressor 11 via a refrigerant pipe 16A (16) on a refrigerant inlet side. The water heat exchanger 12 is connected to the pressure reducing valve 13 via a refrigerant pipe 16B (16) on a refrigerant outlet side.

The pressure reducing valve 13 is provided in the refrigerant pipe 16B and is an electronic expansion valve that is driven by a pulse motor not illustrated in the drawings. The opening of the pressure reducing valve 13 is adjusted according to the number of pulses applied to the pulse motor and thus the volume of the refrigerant flowing into the outdoor heat exchanger 17 is adjusted. The pressure reducing valve 13 is connected to the water heat exchanger 12 via the refrigerant pipe 16B on a refrigerant inlet side. The pressure reducing valve 13 is connected to the outdoor heat exchanger 17 via the refrigerant pipe 16B on the refrigerant outlet side. The refrigerant flowing into the outdoor heat exchanger 17 causes heat exchange between the refrigerant passing inside and outdoor air. The outdoor heat exchanger 17 functions as an evaporator that evaporates the refrigerant passing inside in the heated water heating operation. The outdoor heat exchanger 17 is connected to the pressure reducing valve 13 via the refrigerant pipe 16B on the refrigerant inlet side. The outdoor heat exchanger 17 is connected to the compressor 11 via the refrigerant pipe 16B on the refrigerant outlet side.

Furthermore, the refrigerant circuit 10 includes a high pressure sensor 14 and a low pressure sensor 15. The high pressure sensor 14 is provided between the compressor 11 and the water heat exchanger 12 and detects a condensing pressure of the refrigerant on an ejection side of the compressor 11. The high pressure sensor 14 is a first detector that detects a condensing pressure of the refrigerant on an ejection side of the compressor 11 that circulates the refrigerant in the refrigerant circuit 10. The low pressure sensor 15 is provided between the outdoor heat exchanger 17 and the compressor 11 and detects a pressure of the refrigerant on a suction side of the compressor 11.

Configuration of Water Circuit

The water circuit 20 produces heated water by performing heat exchange between the refrigerant that circulates in the refrigerant circuit 10 and water that circulates in the water circuit 20. The water circuit 20 includes the water heat exchanger 12, a circulation pump 21, a buffer tank 22, and a bypass pipe 23 that are mutually connected via each set of liquid piping 24. The water circuit 20 includes a flow-out pipe 24A via which heated water flows from the water heat exchanger 12 into the use-side terminal group 3 and a flow-in pipe 24B via which heated water flows from the use-side terminal group 3 into the water heat exchanger 12.

The circulation pump 21 is driven, thereby circulating water in the water circuit 20. Note that the circulation pump 21 is a flow adjustment unit that adjusts the flow of water and whose operation capacity is variable according to driving of a motor that is not illustrated in the drawings and whose rotation speed is controlled by an inverter. The buffer tank 22 is a tank that stores water that is circulated in the water circuit 20. The bypass pipe 23 is piping for directly connecting the flow-out pipe 24A and the flow-in pipe 24B when the flow of heated water from the water circuit 20 into the use-side terminal group 3 is blocked.

The water circuit 20 includes a discharged heated-water temperature sensor 26 and a return temperature sensor 25. The discharged heated-water temperature sensor 26 is arranged at the outlet of the water heat exchanger 12 and is a second detector that detects a discharged heated-water temperature that is a temperature of the heated water flowing into the use-side terminal 31. The return temperature sensor 25 is arranged at the inlet of the water heat exchanger 12 and detects a temperature of the heated water flowing into the water heat exchanger 12.

Configuration of Use-Side Terminal Group

The use-side terminal group 3 includes the use-side terminals 31, a branch pipe 32 and a merging pipe 33. The branch pipe 32 is piping that branches the heated water from the water circuit 20 to each use-side terminal 31. The merging pipe 33 is piping that merges the heated water having passed through each use-side terminal 31 and returns the merged heated water to the water circuit 20.

The use-side terminal 31 includes a heat exchanger 35, a flow adjustment valve 34, and an outlet water temperature sensor 36. The heat exchanger 35 performs heat exchange between the heated water from the water circuit 20 branching from the branch pipe 32 and, for example, the air in the indoor space. The flow adjustment valve 34 is a valve that adjusts the flow of the heated water flowing from the branch pipe 32 into the heat exchanger 35. The outlet water temperature sensor 36 is a sensor that detects a temperature of the heated water flowing from the heat exchanger 35.

Each use-side terminal 31 includes, for example, a terminal of the direct contact system, a terminal of the forced convection system, a terminal of the natural convection system, or the like. The terminal of the direct contact system is, for example, a floor-heating device that makes direct contact with a user and that adjusts the room temperature by radiating heat into the indoor space using radiation heat obtained in a way that the heated water of the water circuit 20 flows into a radiation panel (the heat exchanger 35). The terminal of the forced convection system is, for example, a fan convector that adjusts the temperature of the indoor space by causing the air that is heated by the heat exchanger 35 by heat exchange with the heated water flowing in from the water circuit 20 to blow by forced convection of a blower fan, or the like. Like the terminal of the direct contact system, the terminal of the natural convection system adjusts the temperature of the indoor space by radiation heat obtained by causing the heated water of the water circuit 20 to flow into a radiation panel (the heat exchanger 35). The terminal of the natural convection system is, for example, a panel heater.

Configuration of Control Device

The control device 4 includes a storage unit 41 that stores various types of information and a controller 42 that controls the entire heat pump device 1. The storage unit 41 stores pressure thresholds that are thresholds of the condensing pressure, for example, a first threshold, a second threshold, and a third threshold. Each of the thresholds has the relation: the first threshold<the second threshold<the third threshold. The first threshold is a threshold for distinguishing a condensing pressure higher than a condensing pressure in a normal stable operating state (a condensing pressure that makes it possible to ensure reliability of a freezing cycle). The second threshold is a threshold for distinguishing a condensing pressure that is too large to be kept at or under the first threshold by first protection control to be described below. The third threshold is a threshold for distinguishing a condensing pressure that is large such that it is necessary to stop the compressor 11 immediately in view of reliability. Thus, the threshold can be also referred to as a threshold that determines a protection operation to which a switch is made according to a high condensing pressure.

The storage unit 41 stores a temperature threshold that is a fixed threshold for selecting a subject of control from the discharged heated-water temperature.

The controller 42 includes a refrigerant circuit controller 42A that controls the refrigerant circuit 10 and a water circuit controller 42B that controls the water circuit 20. When the condensing pressure that is detected by the high-pressure sensor 14 exceeds the first threshold, the controller 42 executes the protection operation of adjusting the condensing pressure of the refrigerant. Based on the discharged heated-water temperature that is detected by the discharged heated-water temperature sensor 26, the controller 42 selects any one of the compressor 11 and the flow adjustment unit as a subject of control in the protection operation. Specifically, when the detected discharged heated-water temperature is at or above the temperature threshold that is stored in the storage unit 41, the controller 42 sets, for the subject of control, the flow of the circulation pump 21 that is the flow adjustment unit and, when the discharged heated-water is under the temperature threshold, the rotation speed of the compressor 11 is set for the subject of control.

The refrigerant circuit controller 42A in the controller 42 includes a temperature controller 42A1 that changes the rotation speed of the compressor 11 such that the discharged heated-water temperature reaches a target discharged heated-water temperature. Note that the target discharged heated-water temperature is set based on a difference between a setting temperature that is set by the user and a room temperature (indoor heat load). The setting temperature is a temperature that is input as a room temperature that the user of each use-side terminal 31 requests and the room temperature is detected by a room temperature sensor that is not illustrated in the drawings and that is provided in the use-side terminal 31. A difference between a setting temperature and a room temperature is calculated per use-site terminal 31 and a target discharged heated-water temperature that is determined previously by a test, or the like, based on the maximum value of the difference is set. The temperature controller 42A1 controls the rotation speed of the compressor 11 according to an indoor heat load. For example, the larger the rotation speed of the compressor 11 increases, the more the condensing temperature of the refrigerant that circulates in the refrigerant circuit 10 increases, which increases an in increase in the discharged heated-water temperature of the water on which the heat exchange is performed because the condensing temperature of the refrigerant increases.

When the discharged heated-water temperature is at or above the temperature threshold, the water circuit controller 42B in the controller 42 performs control such that the flow of the circulation pump 21 serving as the flow adjustment unit increases. Accordingly, the heat exchange between the refrigerant and water in the water heat exchanger 12 increases and thus the condensing pressure decreases. Specifically, when the discharged heated-water temperature is smaller than the target discharged heated-water temperature and is at or above the temperature threshold, the water circuit controller 42B increases the flow of the circulation pump 21. The condition that "the discharged heated-water temperature is smaller than the target discharged heated-water temperature" will be described below.

When the discharged heated-water temperature corresponds to at least one of the condition of being equal to or larger than the target heated-water temperature and the condition of being under the temperature threshold, the refrigerant circuit controller 42A in the controller 42 reduces the rotation speed of the compressor 11 and reduces the condensing pressure.

Figure 2:
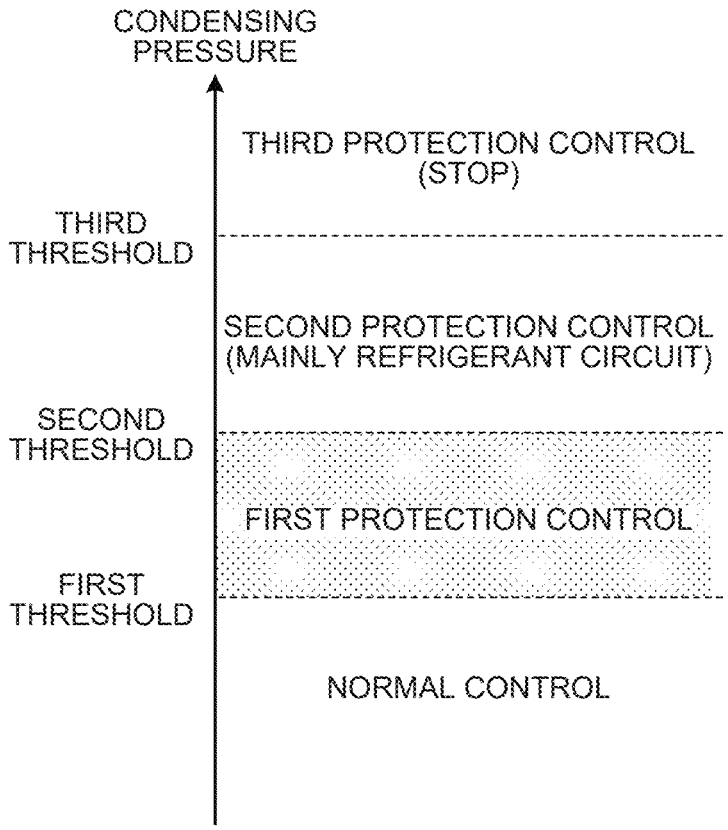
FIG. 2 is an illustration illustrating an example of an operation of protecting a refrigerant circuit with respect to each condensing pressure.

FIG. 2 is an illustration illustrating an example of an operation of protecting the refrigerant circuit 10 with respect to each condensing pressure. When a condensing pressure is at or under the first threshold, the controller 42 does not execute the protection operation and keeps a normal heated-water heating operation. When the condensing pressure exceeds the first threshold and is at or under the second threshold, the controller 42 determines that the condensing pressure is a condensing pressure higher than normal and executes the first protection control. The first protection control is control of selecting any one of the flow adjustment unit (the circulation pump 21) and the compressor as a subject of control in the protection operation based on the discharged heated-water temperature and reducing the condensing pressure.

When executing the first protection control, in the case where the discharged heated-water temperature that is detected is at or above the temperature threshold that is stored in the storage unit 41, the controller 42 sets the flow of the circulation pump 21 serving as the flow adjustment unit for the subject of control and, in the case where the discharged heated-water temperature is under the temperature threshold, the controller 42 sets the rotation speed of the compressor 11 for the subject of control. As described above, the reason for switching the protection control according to the magnitude of the discharged heated-temperature with respect to the temperature threshold is that the effect of reducing the refrigerant pressure by increasing the flow of water differs depending on the discharged heated-water temperature. The indoor heat load is large when the discharged heated-water temperature is high and thus the heat discharge of water in each use-side terminal 31 is large. When the heat discharge of water in each use-side terminal 31 is large, the difference between the discharged heated-water temperature and a return temperature increases. When the difference between the discharged heated-water temperature and the return temperature is large, a difference in temperature between the water and the refrigerant increases in the water heat exchanger 12. Thus, increasing the flow of the water increases the effect of reducing the refrigerant pressure. On the other hand, when the discharged heated-water temperature is low, because the difference in temperature between the water and the refrigerant is small in the water heat exchanger 12, the effect of reducing the condensing pressure is low even when the flow of the water is increased. Thus, the flow of the circulation pump 21 is not set for the subject of control.

When the condensing pressure exceeds the second threshold and is at or under the third threshold, the controller 42 executes second protection control. The second protection control is control of selecting the compressor 11 in the refrigerant circuit 10 as the subject of control in the protection operation and reducing the condensing pressure by lowering the rotation speed of the compressor 11. The second threshold is a threshold for distinguishing a condensing pressure that is too large to be kept at or under the first threshold by the first protection control to be described below. For this reason, in order to reduce the condensing pressure, it is necessary to lower the rotation speed of the compressor 11 even if the discharged heated-water temperature lowers.

When the condensing pressure exceeds the third threshold, the controller 42 executes third protection control. The third protection control is control of stopping the compressor 11 in the refrigerant circuit 10. The third threshold is a threshold for distinguishing a condensing pressure that is large such that it is necessary to stop the compressor 11 immediately in view of reliability. Stopping the compressor 11 makes it possible to inhibit reliability in reducing the condensing pressure from lowering.

Figure 3:
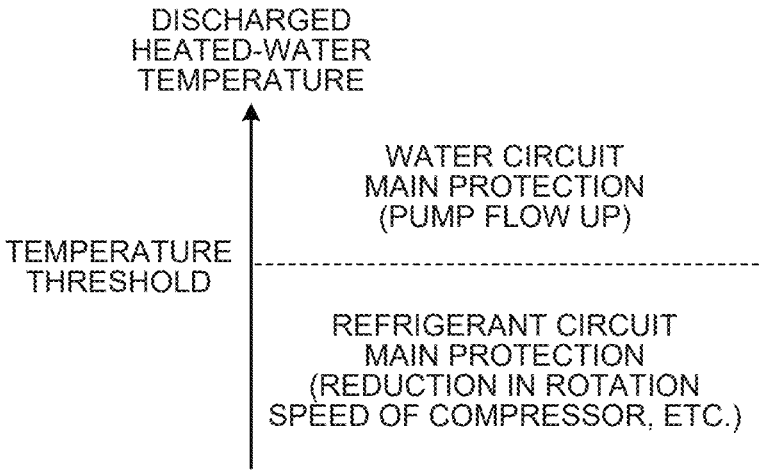
FIG. 3 is an illustration illustrating an example of a subject of control with respect to each discharged heated-water temperature.

FIG. 3 is an illustration illustrating an example of a subject of control with respect to each discharged heated-water temperature. When the discharged heated-water temperature is under the temperature threshold under the first protection control, the controller 42 selects the compressor 11 in the refrigerant circuit 10 and controls the rotation speed of the compressor 11 to reduce the condensing pressure. When the discharged heated-water temperature is at or above the temperature threshold under the first protection control, the controller 42 performs control to increase the flow of the circulation pump 21 in the water circuit 20.

As described above, when the condensing pressure exceeds the first pressure threshold, the controller 42 executes the first protection control of selecting any one of the flow adjustment unit and the compressor 11 as the subject of control in the protection operation based on the discharged heated-water temperature that is detected and reducing the condensing pressure.

When the condensing pressure exceeds the second pressure threshold higher than the first pressure threshold, the refrigerant circuit controller 42A in the controller 42 executes the second protection control of selecting the compressor 11 in the refrigerant circuit 10 as the subject of control in the protection operation and reducing the condensing pressure. When the condensing pressure exceeds the third pressure threshold higher than the second pressure threshold, the refrigerant circuit controller 42A in the controller 42 executes the third protection control of stopping the compressor 11.

Operation of Heat Pump Device

Figure 4:
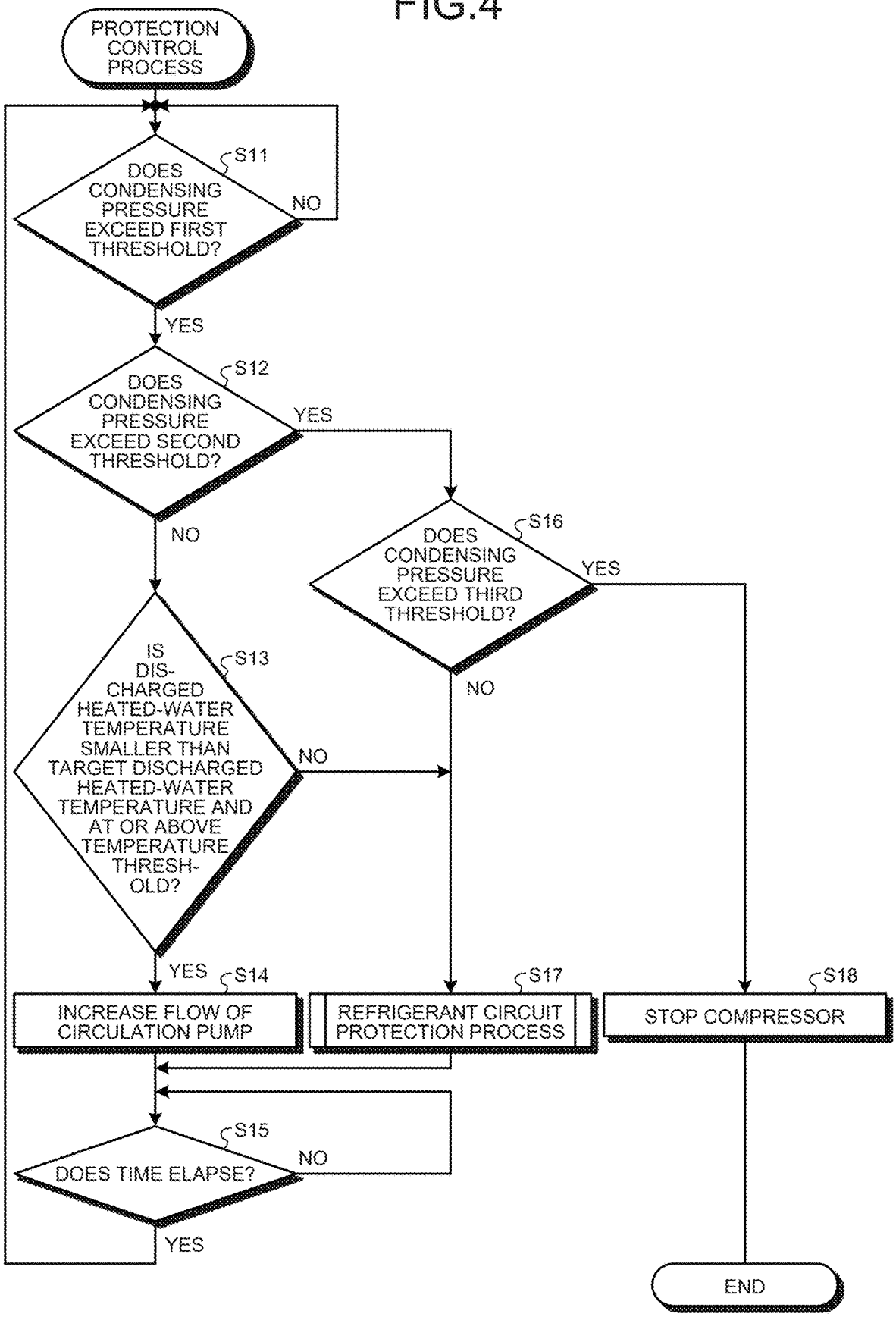
FIG. 4 is a flowchart illustrating an example of process operations of a control device that relate to a protection control process.

FIG. 4 is a flowchart illustrating an example of process operations of the control device 4 that relate to a protection control process. According to FIG. 4, the controller 42 in the control device 4 determines whether the condensing pressure exceeds the first threshold (step S11). When the condensing pressure exceeds the first threshold (step S11: Yes), the controller 42 determines whether the condensing pressure exceeds the second threshold (step S12).

When the condensing pressure does not exceed the second threshold (step S12: No), the controller 42 determines whether the discharged heated-water temperature is smaller than the target discharged heated-water temperature and is at or above the temperature threshold (step S13). When the discharged heated-water temperature is smaller than the target discharged heated-water temperature and is at or above the temperature threshold (step S13: Yes), the controller 42 controls the circulation pump 21 in order to increase the flow of the circulation pump 21 in the first protection control (step S14) and determines whether a given time elapses (step S15). Note that the process at step S15 is a process of determining whether the given time elapses from the start of the process at step S14 or step S17.

When the given time elapses (step S15: Yes), the controller 42 returns to the process at step S11 in order to determine whether the condensing pressure exceeds the first threshold. When the condensing pressure does not exceed the first threshold (step S11: No), the controller 42 does not perform the protection control and returns to the process at step S11 in order to determine whether the condensing pressure exceeds the first threshold.

When the condensing pressure exceeds the second threshold (step S12: Yes), the controller 42 determines whether the condensing pressure exceeds the third threshold (step S16). When the condensing pressure does not exceed the third threshold (step S16: No), the controller 42 executes a refrigerant circuit protection process illustrated in FIG. 5 (step S17). The controller 42 then returns to the process at step S15 in order to determine whether the given time elapses.

When the condensing pressure exceeds the third threshold (step S16: Yes), the controller 42 stops the compressor 11 (step S18) and ends the process operations illustrated in FIG. 4. When the discharged heated-water temperature corresponds to at least any one of the condition of being equal to or larger than the target discharged heated-water temperature or the condition of being under the temperature threshold (step S13: No), the controller 42 shifts to the process at step S17 in order to execute the refrigerant circuit protection process illustrated in FIG. 5. When the given time does not elapse (step S15: No), the controller 42 returns to the process at step S15 in order to determine whether the given time elapses.

Figure 5:
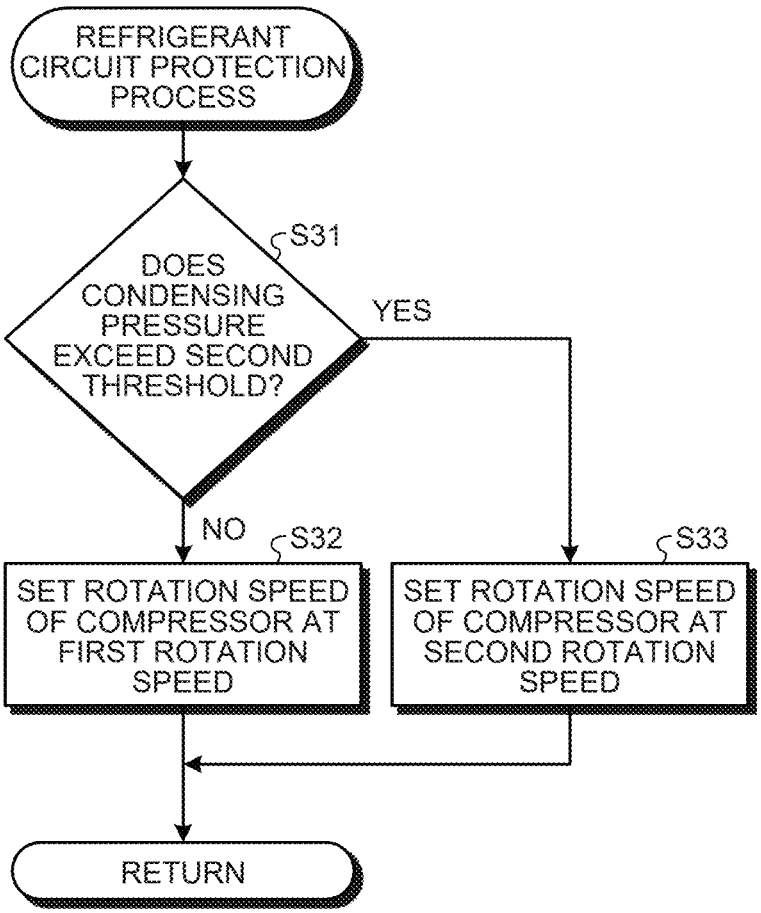
FIG. 5 is a flowchart illustrating an example of process operations of the control device that relate to a refrigerant circuit protection process.

FIG. 5 is a flowchart illustrating an example of process operations of the control device 4 that relate to the refrigerant circuit protection process. In the refrigerant circuit protection process, the compressor rotation speed is set at two stages according to the level of the condensing pressure for the pressure protection operation not to be excessive. According to FIG. 5, the controller 42 determines whether the condensing pressure exceeds the second threshold (step S31). When the condensing pressure is under the second threshold (step S31: No), the controller 42 sets the rotation speed of the compressor 11 at a first rotation speed smaller than a normal rotation speed in order to reduce the condensing pressure (step S32) and ends the process operations illustrated in FIG. 5.

When the condensing pressure exceeds the second threshold (step S31: Yes), the controller 42 sets the rotation speed of the compressor 11 at a second rotation speed smaller than the first rotation speed in order to reduce the condensing pressure (step S33). The controller 42 then ends the process operations illustrated in FIG. 5.

Figure 6:
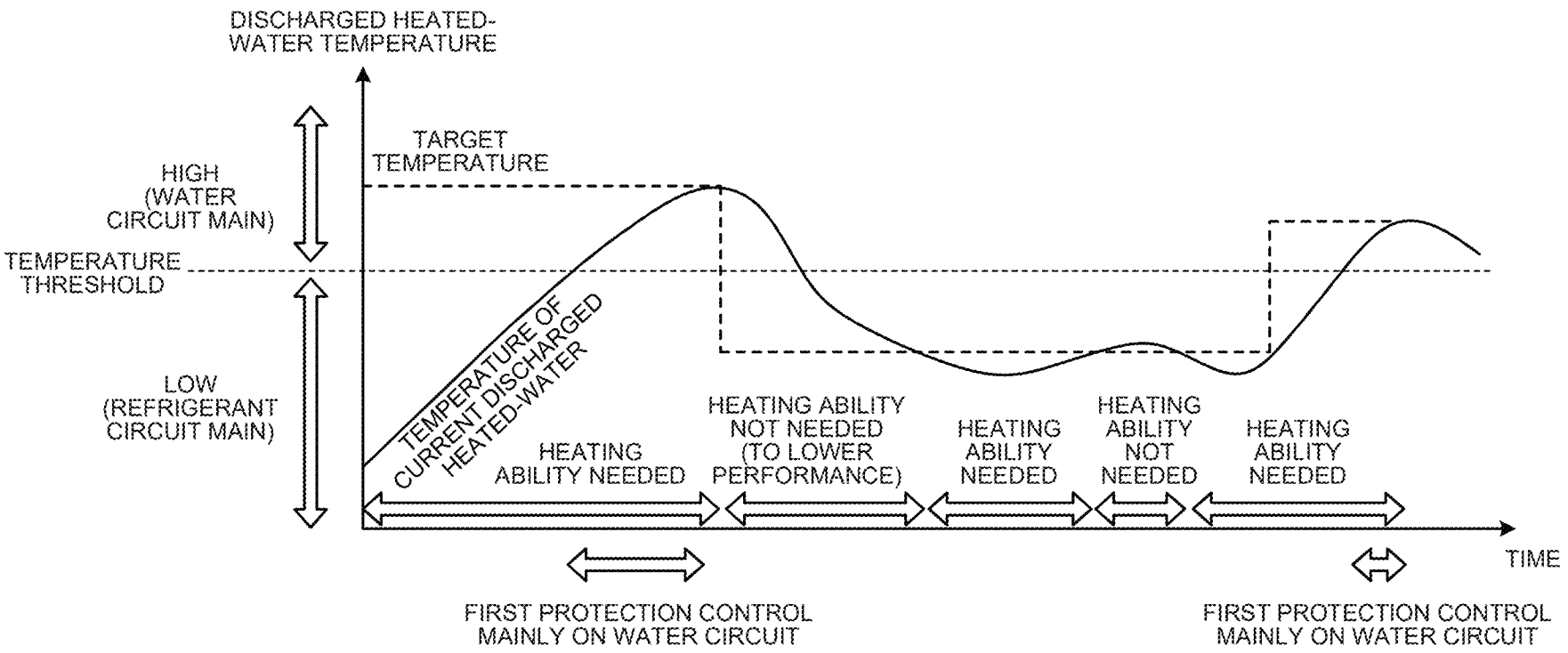
FIG. 6 is an illustration illustrating an example of transition of heating ability of the heat pump device that relates to the protection control process.

FIG. 6 is an illustration illustrating an example of transition of heating ability of the heat pump device 1 that relates to the protection control process. Ability to heat heated water (referred to as heating ability for convenience) is needed until the current discharged heated-water temperature reaches the target discharged heated-water temperature. Note that the target discharged heated-water temperature varies according to the indoor heat load and at least the maximum value of the target discharged heated-water temperature is a value larger than the temperature threshold. When the discharged heated-water temperature is at or above the temperature threshold in the process of increasing toward the target discharged heated-water temperature and the condensing pressure exceeds the first threshold, the first protection control mainly on the water circuit 20 is executed in order to increase the flow of the circulation pump 21 serving as the flow adjustment unit. When the flow of the circulation pump 21 increases, the heat exchange in the heat exchanger 35 of the use-side terminal 31 increases and accordingly the heating ability increases compared to the case where the normal control is executed. When the current discharged heated-water temperature is smaller than the target discharged heated-water temperature and the current discharged heated-water temperature is at or above the temperature threshold, however, the heating ability of the use-side terminal 31 is needed and thus, even when the flow of the circulation pump 21 is increased, this does not lead to a decrees in comfortableness to the user that is caused by excessive heating.

On the other hand, when the current discharged heated-water temperature is above the target discharged heated-water temperature, the heating ability is unnecessary and the current discharged heated-water temperature lowers gradually. When the condensing pressure exceeds the first threshold in the process where the discharged heated-water temperature lowers to the target discharged heated-water temperature, even if the first protection control mainly on the refrigerant circuit 10 that lowers the rotation speed of the compressor 11 is performed, the heating ability is not needed initially and thus comfortableness to the user is not diminished.

Effect of Embodiment

When the detected condensing pressure exceeds the first pressure threshold and the discharged heated-water temperature is at or above the temperature threshold, the heat pump device 1 of the embodiment reduces the condensing pressure by increasing the flow of the circulation pump 21 in the water circuit 20. Furthermore, when the discharged heated-water temperature is under the temperature threshold, the heat pump device 1 reduces the condensing pressure by setting the rotation speed of the compressor 11 in the refrigerant circuit 10 at the first rotation speed. In other words, even when the condensing pressure increases, a switch to protection control mainly on the water circuit 20 is made in the case where the discharged heated-water temperature is at or above the temperature threshold and a switch to protection control mainly on the refrigerant circuit 10 is made in the case where the discharged heated-water temperature is under the temperature threshold. As a result, it is possible to perform the pressure protection operation appropriately while minimizing a decrease in comfortableness.

When the condensing pressure exceeds the first pressure threshold and exceeds the second pressure threshold, the heat pump device 1 reduces the condensing pressure by setting the rotation speed of the compressor 11 at the second rotation speed. Furthermore, when the condensing pressure exceeds the second pressure threshold and exceeds the third pressure threshold, the heat pump device 1 stops the compressor 11. As a result, it is possible to perform the pressure protection operation appropriately by changing the subject of control in stages according to the level of the condensing pressure.

Note that, for convenience of description, the discharged heated-water temperature sensor 26 that is arranged at the outlet of the water heat exchanger 12 and that detects the discharged heated-water temperature that is the temperature of the heated water flowing into the use-side terminal 31 is exemplified as the second detector. The second detector however is not limited to the outlet of the water heat exchanger 12, and the second detector only need to detect the discharged heated-water temperature that is the temperature of the heated water until the flow from the outlet of the water heat converter 12 into the inlet of the heat exchanger 35 in the use-side terminal 31 and changes can be made as appropriate.

The case where the flow adjustment unit is the circulation pump 21 that is provided in the water circuit 20 and the flow of the circulation pump 21 is increased when the discharged heated-water temperature is at above the temperature threshold is exemplified. The flow adjustment unit however is not limited to the circulation pump 21 and the flow adjustment unit may be a flow adjustment valve and, in this case, when the discharged heated-water temperature is at or above the temperature threshold, the controller 42 increases the flow of the heated water by opening the flow adjustment valve. As a result, it is possible to reduce the condensing pressure.

The case where, when the discharged heated-water temperature is at or above the temperature threshold, the controller 42 increases the flow of the circulation pump 21 has been exemplified. When the discharged heated-water temperature is at or above the temperature threshold, however, the controller 42 may increase the flow of the circulation pump 21 and increase the flow of heated water by opening the flow adjustment valve, and changes can be made as appropriate.

Each component of each unit illustrated in the drawings need not necessarily be configured physically as illustrated in the drawings. In other words, specific modes of distribution and integration of each units are not limited to those illustrated in the drawings and all or part of the units can be configured by functional or physical distribution or integration in any unit according to various types of load and usage.

Furthermore, all or given part of various types of processing functions implemented by each device may be executed on a CPU (Central Processing Unit) (or a microcomputer, such as a MPU (Micro Processing Unit) or a MCU (Micro Controller Unit)). Needless to say, all or any part of the various types of processing functions may be executed on a program that is analyzed and executed by the CPU (or a microcomputer, such as a MPU or a MCU) or on hardware according to a wired logic.

REFERENCE SIGNS LIST

1 HEAT PUMP DEVICE
3 USE-SIDE TERMINAL GROUP
4 CONTROL DEVICE
10 REFRIGERANT CIRCUIT
11 COMPRESSOR
14 HIGH PRESSURE SENSOR
20 WATER CIRCUIT
21 CIRCULATION PUMP
26 DISCHARGED HEATED-WATER TEMPERATURE SENSOR
42 CONTROLLER
42A REFRIGERANT CIRCUIT CONTROLLER
42B WATER CIRCUIT CONTROLLER
42A1 TEMPERATURE CONTROLLER

The invention claimed is:

1. A heat pump device comprising:

a refrigerant circuit that includes a compressor and in which a refrigerant circulates;

a water circuit in which water circulates, that includes a flow adjustor that adjusts a flow of the water, and that produces heated water by heat exchange of the water with the refrigerant; and a terminal that is connected to the water circuit, wherein the heat pump device includes:

a first detector that detects a condensing pressure of the refrigerant of the refrigerant circuit;

a second detector that detects a discharged heated-water temperature that is a temperature of the water flowing into the terminal; and a controller that executes a protection operation of adjusting the condensing pressure of the refrigerant when the condensing pressure that is detected by the first detector exceeds a pressure threshold, and the controller selects, as a subject of control in the protection operation, any one of the compressor and the flow adjustor based on the discharged heated-water temperature that is detected by the second detector.

2. The heat pump device according to claim 1, wherein the controller sets the flow adjustor for the subject of control when the discharged heated-water temperature is at or above a temperature threshold and sets the compressor for the subject of control when the discharged heated-temperature is under the temperature threshold.

3. The heat pump device according to claim 1, wherein the controller includes a temperature controller that changes a rotation speed of the compressor such that the discharged heated-water temperature reaches a target discharged heated-water temperature, and when the discharged heated-water temperature is smaller than the target discharged heated-water temperature and is at or above the temperature threshold, the controller reduces the condensing pressure by controlling the flow adjustor and, when the discharged heated-water temperature corresponds to at least one of a condition of being equal to or larger than the target discharged heated-water temperature and a condition of being under the temperature threshold, the controller reduces the condensing pressure by reducing the rotation speed of the compressor.

4. The heat pump device according to claim 2- or 3, wherein the flow adjustor is a circulation pump that is provided in the water circuit, and when the discharged heated-water temperature is at or above the temperature threshold, the controller increases a flow of the circulation pump.

5. The heat pump device according to claim 2- or 3, wherein the flow adjustor is a flow adjustment valve that is provided in the water circuit, and when the discharged heated-water temperature is at or above the temperature threshold, the controller increases the flow of the heated water by opening the flow adjustment valve.

6. The heat pump device according to claim 1, wherein when the condensing pressure exceeds a first pressure threshold, the controller selects any one of the flow adjustor and the compressor as the subject of control in the protection operation based on the discharged heated-water temperature that is detected by the second detector and reduces the condensing pressure, when the condensing pressure exceeds the first pressure threshold and exceeds a second pressure threshold higher than the first pressure threshold, the controller selects the compressor as the subject of control in the protection operation and reduces the condensing pressure, and when the condensing pressure exceeds the second pressure threshold and exceeds a third pressure threshold higher than the second pressure threshold, the controller stops the compressor.

7. The heat pump device according to claim 1, wherein the first detector is a high-pressure sensor that detects the condensing pressure on an ejection side of the compressor that circulates the refrigerant in the refrigerant circuit.

* * * * *